United States Patent [19]

Mikschl

[11] Patent Number: 4,789,773

[45] Date of Patent: Dec. 6, 1988

[54] ELECTRICAL RADIANT HEATER FOR HEATING HEATING SURFACES

[75] Inventor: Bernhard Mikschl, Sulzfeld, Fed. Rep. of Germany

[73] Assignee: E.G.O. Elektro-Gerate Blanc u. Fischer, Fed. Rep. of Germany

[21] Appl. No.: 887,255

[22] Filed: Jul. 18, 1986

[30] Foreign Application Priority Data

Jul. 31, 1985 [DE] Fed. Rep. of Germany ..... 3527413

[51] Int. Cl.[4] ..... H05B 3/96

[52] U.S. Cl. ..... 219/464; 219/460; 219/463; 219/536; 219/542; 338/278; 338/279; 338/282; 338/297

[58] Field of Search ..... 219/460, 463, 464, 467, 219/264, 265, 542, 536; 338/278, 279, 280, 281, 282, 297, 30

[56] References Cited

U.S. PATENT DOCUMENTS

| | | | |
|---|---|---|---|
| 2,235,091 | 3/1941 | Vineberg | 201/63 |
| 3,047,702 | 7/1962 | Lefebure | 219/542 |
| 3,991,298 | 11/1976 | Maake | 219/464 |
| 4,161,648 | 7/1979 | Göessler | 219/464 |
| 4,243,874 | 1/1981 | Fischer | 219/467 |
| 4,380,116 | 4/1983 | Gössler et al. | 219/457 |
| 4,388,520 | 6/1983 | McWilliams | 219/464 |

FOREIGN PATENT DOCUMENTS

| | | | |
|---|---|---|---|
| 0033788 | 8/1981 | European Pat. Off. | 219/542 |
| 2740163 | 9/1978 | Fed. Rep. of Germany . | |
| 2855382 | 6/1979 | Fed. Rep. of Germany | 219/542 |
| 2820138 | 11/1979 | Fed. Rep. of Germany . | |
| 2729929 | 8/1980 | Fed. Rep. of Germany . | |
| 3437940 | 4/1986 | Fed. Rep. of Germany | 219/542 |

OTHER PUBLICATIONS

German Search Report Appln. P 35 27 413.1.

*Primary Examiner*—A. D. Pellinen
*Assistant Examiner*—Jeffrey A. Gaffin
*Attorney, Agent, or Firm*—Steele, Gould & Fried

[57] ABSTRACT

An electric radiant heater (11) for heating a glass ceramic cooking surface (12) contains a dish-shaped insulator (14), to whose inner bottom surface (18) are fixed heater coils (20). The heater coils have an oval cross-section and are pressed by their narrow sides into surface (18) and fixed. The fixing pressing in takes place during the moulding of the moist insulator (14), made from fibrous material and by means of a male mould receiving the heater coils in slots.

15 Claims, 2 Drawing Sheets

FIG. 1
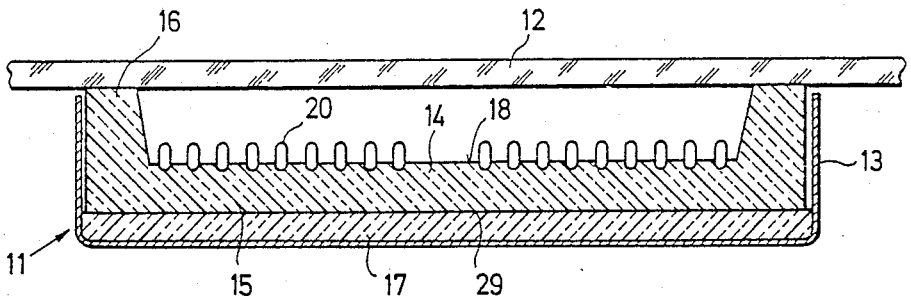
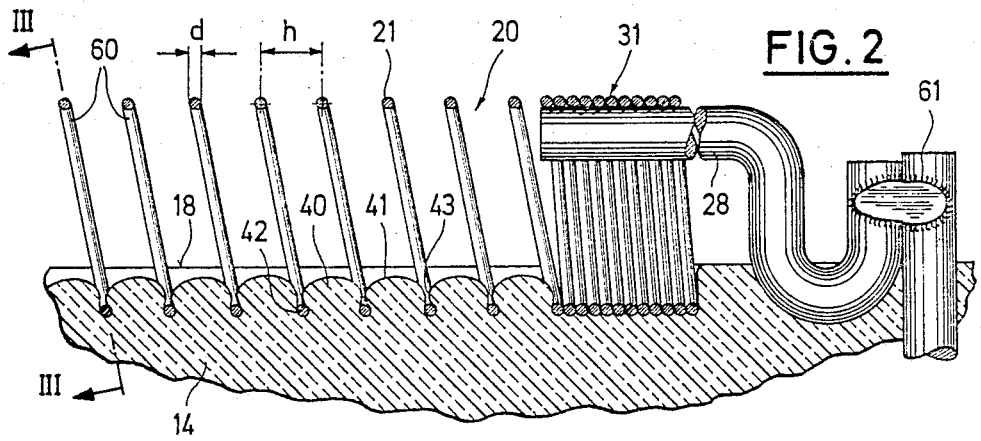
FIG. 2
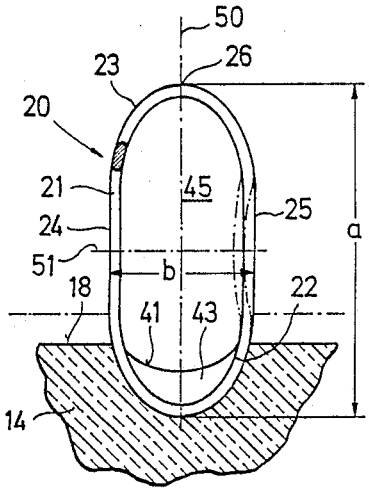
FIG. 3
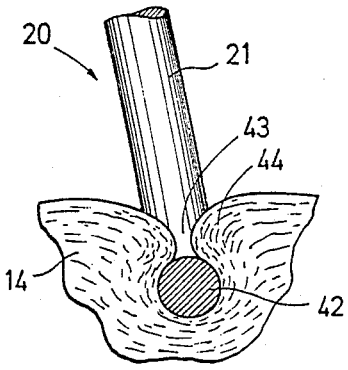
FIG. 4

ELECTRICAL RADIANT HEATER FOR HEATING HEATING SURFACES

BACKGROUND

The invention relates to an electric radiant heater for heating heating surfaces, as well as to a process and an apparatus for producing the same.

DE-OS No. 27 29 929 discloses a radiant heater, in which the heater coils having a circular cross-section are embedded into the surface of an insulator containing fibrous material by pressing in and which are in this way fixed. Reference is also made therein to the fact that the heater coils can have an oval shape and can be flat, i.e. the smallest extension or small axis thereof is directed towards the heating plate, in order to save overall height.

This type of embedding functions perfectly if the wire thickness of the heater coil does not drop below a certain value and the overall length thereof is not too large compared with the available surface area. However, for many radiant heaters, e.g. those operated in a multitiming circuit, the necessary wire lengths are very large and the wire diameter small, particularly in construction for higher voltages (380 V). In the case of the then necessary limited coil pitches and the reduced coil stability, completely satisfactory fixing is no longer possible.

OBJECTS AND SUMMARY OF THE INVENTION

The problem of the present invention is to provide an electric radiant heater, whose heater coil can be produced with a small wire diameter in the case of good fixing to the insulator and a relatively small proportion of embedded heating resistance surface (degree of embedding).

The invention embedding of a roughly oval wire coil on one of the narrow sides thereof leads to a number of advantages. For a given coil width in the direction of the surface, i.e. per usable surface unit, the wire length is made larger by the oval shape than with a circular coil and much larger than with a horizontal oval shape. Furthermore, through embedding a given fraction of its overall wire length, the coil is fixed much better, because a much larger arc portion can be secured. Thus, e.g. when embedding a 180° arc, the latter need only represent $\frac{1}{3}$ or $\frac{1}{4}$ of the total winding circumference, so that an adequate radiation surface remains. Due to the greater total length of the wiretype resistance material to be housed, it is also possible to have a larger coil pitch, i.e. the proportion of the gaps between the individual turns, so that penetration into the embedding material is aided. However, in particular the penetration of the more markedly curved lateral face into the material can be brought about more easily on pressing in, even thin wires do not tend to deform or tilt over in the longitudinal direction of the coil and assume a flat position. This is assisted by the fact that on inserting more than $\frac{2}{3}$ or $\frac{3}{4}$ of the coil circumference in a slot, the coil can be guided and the pressure acting on the free apex presses the flatter sides of the oval against the slot walls and consequently stiffens the coil, which also has a large section modulus in the transverse direction.

BRIEF DESCRIPTION OF THE DRAWINGS

This and further features of the invention can be gathered from the subclaims, description and drawings, whereby the individual features can be realized singly or in the form of subcombinations in an embodiment of the invention and in other fields.

Embodiments of the invention are represented in the drawings and explained in greater detail hereinafter relative thereto and wherein show:

FIG. 1 A diagrammatic section through an electric radiant heater and a heating plate.

FIG. 2 A larger scale section through a detail of the radiant heater with heater coil.

FIG. 3 A larger scale cross-section along line III—III in FIG. 2.

FIG. 4 A greatly enlarged detail from FIG. 2.

DETAILED DESCRIPTION OF THE PREFERRED EMBODIMENTS

Figure 5:
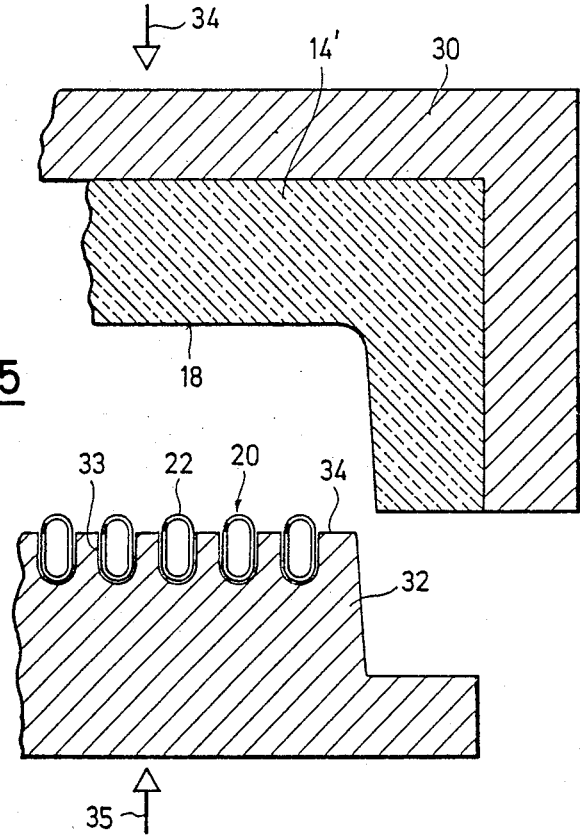
FIGS. 5 and 6 Two production stages in connection with the radiant heater and associated apparatus.

The radiant heater 11 shown in FIG. 1 is used for heating a glass ceramic heating surface 12 or several ceramic heating surfaces. Although it is preferably used for heating one of several hotpoints of a continuous cooking surface, it can also be used for individual hotplates and the like.

The radiant heater 11 contains a sheet metal support tray 13, in which is arranged an insulator 14 which, like the tray is dish-shaped, with a circular bottom 15 and an all-round rim or edge 16. For better thermal insulation, a mechanically less strong, but thermally excellent insulating layer 17, e.g. of pyrogenic silicic acid and can be placed below this mechanically strong, manipulatable insulator 14. The insulator is pressed by the upper face of rim 16 on to the underside of cooking surface 12 by means of not shown spring elements. It is preferably made from a fibrous, high temperature-resistant insulating material, e.g. an aluminum oxide fibre marketed under the trade name "Fiberfrax". However, it is also possible to use other mineral fibres or other mouldable insulating materials, such as e.g. vermiculite.

Heater coils 20 made from wire-like, electrical resistance material 21 are partly pressed into and fixed in the substantially planar surface 18 of bottom 15 of insulator 14. Each turn 60 of heater coil 20 has a roughly oval configuration, cf. particularly FIG. 3, which comprises two roughly semicircular arcs on the narrow sides of the oval and two substantially linear or slightly outwardly or inwardly curved sides 24, 25 connecting the same (dot-dash line in FIG. 3). The more strongly curved narrow sides 22, 23 can, diverging from the semicircular shape, be curved somewhat more in the vicinity of the apex 26 thereof. They are produced in that initially narrow coil, i.e. circularly wound turn to turn is given the roughly oval shape by pressure between two pairs of jaws or rollers and finally by mechanical stretching to the desired length or coil pitch (shown to the left of FIG. 2) and fixing in substantially stress-free manner in this shape by glowing under self-heating as a result of the passage of current. Due to the way in which the oval shape is obtained, the shape shown in FIG. 3 is also obtained and this has proved to be very advantageous for the desired purpose. In particular, the more marked, ogival curvature in the vicinity of the apex 26 facilitates the penetration into the insulator, whilst the straight sides ensure a good guidance in the production tool. However, it is also possible to use other oval or oval-like shapes, which have a clear difference in dimensions between the vertical and horizontal extension thereof. All these cross-sectional shapes are referred to as roughly oval herein.

Insulator 14 is produced by the following process. From a suspension of insulating fibres in water, to which can also be added conventional inorganic or organic binders, the fibres are sucked from a pulp mould or preform screen forming a thickness-increased negative of the insulator, but with a free lower base 29. A thickening on base 29 is cut off and, optionally following prepressing, the soft, moist insulator 14' (FIG. 5) is placed in a mould 30.

The prepared oval heater coils are inserted over their entire length in slots 33 following the welding on of connecting pins 28 in the vicinity of non-distorted ends. The shape of the slots corresponds to the oval shape of the heater coils 20, but are less deep. The oval heater coils are consequently inserted in slots 33 with an upright cross-section and roughly ⅓ to ¼ of the larger cross-sectional dimensions a thereof (FIG. 3) project over a pressing plate 34 of the male mould 32 carrying the slots. The width of the slots is such that the heater coils can be readily inserted, but are precisely guided in an optimum manner. In the cause of circular heaters, the slots 33 are generally spiral, namely in the form of a single or multiple spiral, or also as a double spiral having a reversal point in the centre and can comprise one or more coil portions, which are in each case provided with electrical connecting pins 28, which are welded to conductors 61 passed through the insulator 14.

Figure 6:
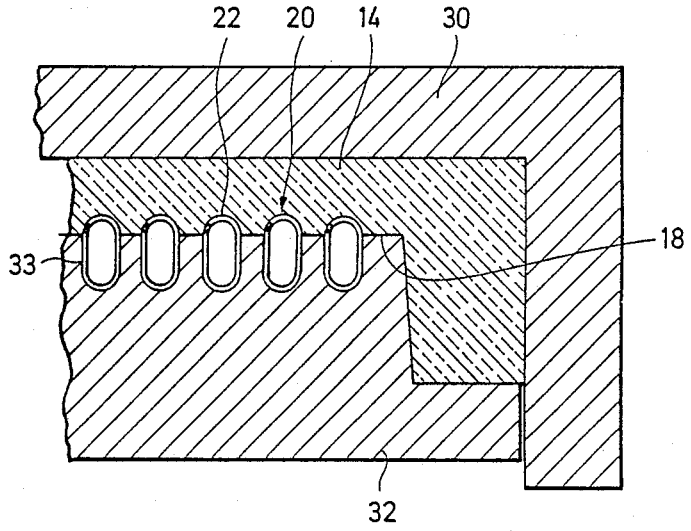

The insert male mould 32 and the mould 30 are moved towards one another in the direction of arrows 34 and 35 and the male mould presses the still plastically deformable insulator preform 14' into it final shape 14 shown in FIG. 6. Heater coils 20 with their narrow sides 22 are pressed and fixed in the surface 18 and consequently the insulator material.

Particularly if the heater coils are made from very thin resistance material of approximately 0.15 to 0.25 mm, this would virtually be impossible with circular coils. As a result of the oval shape and the good guidance in slots 33, even greater pressing of the insulator is possible, thereby leading to good fixing. As a result of the good guidance, the coils do not tend to laterally bend away and can also not tilt over in the longitudinal direction thereof, because as a result of the pressure on the curved coil portion 22, the sides 24, 25 spread apart somewhat and are secured on the inner wall of the slot (FIG. 6). Good fixing is also helped by the fact that the coil pitch h (FIG. 2) is relatively large compared with the diameter d of the resistance material 21 and consequently there is sufficient space for the fibrous material to penetrate between the turns 60 and form a bead 40. Although the surface 41 thereof remains somewhat below the uninfluenced, planar surface 18 of insulator 14, it still above the penetrated turn portions 42. The latter cut into the fibrous material, which at least partly closes again behind them. It is advantageous that the penetration leads to the formation of depressions or channels 43, which only partly close again over the penetrated turn portion 42. Thus, the portion also permits an irradiation or heat emission without any assistance of the insulator and also the fibres 44 engaging over said turn portion 42 give a particularly elastic hold, which does not break away even in the case of movements caused by thermal expansion. As a function of the materials and dimensions used, the embedding can be varyingly complete and deep and the depressions 43 can also be completely closed, particularly if a less elastic and fibrous material is used. FIG. 3 shows that the coil embedding on the outer edge of each turn is somewhat higher than on the inner edge, so that in the vicinity of the heater coil a flat channel is formed, which favours fixing. It is particularly apparent that it is possible to keep most of the coil interior 45 free from insulating material, so that there can be not heat build-up there, which could lead to premature mechanical and thermal wear to the heater coils.

Following the moulding shown in FIG. 6, the insert male mould 32 and mould 30 are separated again, the heater coils remaining in the insulator. They can easily be drawn out of the slots 33 because, on relieving the male mould, they spring together somewhat again and have a clearance with respect to the slot walls. The now moulded, but still moist insulator 14 is brought into its relatively solid final state by drying or other hardening measures.

The invention makes it possible to house large wire lengths on a given surface unit, so that it is also possible to produce heaters in multitiming circuit with small partial outputs. This is helped by the relatively large ratio between the possible coil pitch h to the wire diameter d of the resistance material 21 of preferably h:d=2:10 also helps to ensure that the radiation and ventilation conditions are good. As the oval shape also improves the possibility of fixing, apart from increasing the wire diameter for a given width, it is possible to arrange the coils in relatively closely juxtaposed spiral paths, so that this also leads to an increase in the wire length to be housed per surface unit, together with a very uniform heating. The preferred uniform fixing of the heater coils over the entire length thereof also prevents coil creeping movements and even in the case of a very limited spacing leads to short-circuit-proof characteristics. However, if there is an interest in extremely close occupancy, it would also be possible to carry out fixing in spaced ribs or studs. The preferred ratio between the length of the large or major axis a of the oval coil cross-section located on heating surface 12 and directed away from the insulator to the transverse dimensions b in the direction of the small or minor oval axis 51 is more than 1.5 and preferably approximately 2. Conventionally the major axis 50 (FIG. 3) is roughly perpendicular to the insulator surface 18. However, in the case of corresponding ratios, it is also possible for it to slope, provided that it is possible to retain the advantage resulting from the preferred pressing in of the narrow side 22 into the insulator. The good guidance and stability of the heater coil and the "cutting action" of the relatively thin wires which can be used also make it possible to press into insulating materials having a relatively high resistance to penetration and which can be used without a hardening or drying process following moulding, these in particular including granular insulating materials.

The preferred coil pitch/wire diameter (distortion) ratio values h/d can change as a function of the axial length ratio a/b of the oval coil cross-section and the absolute wire diameters. In the case of a Fiberfrax insulator, it has been found that good fixing ratios for a wire diameter d=0.25 mm can be obtained at a/b=2 and h/d=2.5 or higher, the minimum values for h/d being reduceable in the case of a larger a/b and increasable with a smaller a/b (e.g. for a/b=1.5 to h/d=3). However, smaller wire diameters permit larger h/d values, e.g. d=0.18; a/b=2; h/d over 3. These ratios can change as a function of the fibre length, suction density, fibre quality, binder proportion, etc. of the insulator.

As a result of the relatively large pressing in depth compared with the coil diameter, tolerances in the coil dimensions and the pressing in depth have a less marked effect.

What is claimed is:

1. Electric radiant heater for heating heating surfaces, comprising an insulator made from electrically and thermally insulating material, at least one heater coil having numerous spaced turns of electrical resistance wire being partly embedded in a surface of said insulator, the heater coil having a substantially oval coil cross-section having a cross-sectional major and a minor axis and with two facing sides each having a respective cross-sectional major and minor curvature, a portion of the heater coil being embedded at the heater coil side of major curvature whereby major axis of the coil cross-section is directed away from said surface of the insulator.

2. Radiant heat according to claim 1, wherein the oval coil cross-section comprises two, substantially semicircular sides, which are more curved in the apex region and sides connecting the same having a substantially linear configuration of the resistance wire.

3. Radiant heat according to claim 2, wherein on the outsides of the heater coil the embedding extends up to sides with a substantially linear configuration of the resistance wire.

4. Radiant heater according to claim 1, wherein the heater coil embedded over the entire length thereof in a substantially uniform manner for each turn, but only over a portion taking up a fraction of the turn circumference.

5. Radiant heater according to claim 1, wherein the insulator preponderantly comprises fibres combined into a relatively rigid body.

6. Radiant heater according to claim 5, wherein in the embedded portion, fibres of insulator passing into the coil interior overlap the resistance wire, but the remainder of the coil interior is substantially free from insulating material.

7. Radiant heater according to claim 1, wherein the embedded portion is located in depressions running along the length at the wire and which are partly open towards the surface of insulator.

8. Radiant heater according to claim 1, wherein the turns of resistance wire are further surrounded by the material of insulator on the outsides thereof than in the coil interior.

9. Radiant heater according to claim 1, wherein several different heater coils are embedded in spiral paths in an insulator.

10. Radiant heater according to claim 1, wherein the ratio of the major to minor axis of the oval coil cross-section is larger than 1.5 and preferably approximately 2.

11. Radiant heater according to claim 1, wherein the ratio of the coil pitch (h) to the diameter (d) of the resistance wire is greater than 2 and preferably between 4 and 8.

12. Radiant heater according to claim 1, wherein the heater coil is a press-formed coil having two lateral sides being flattened by pressing it into oval shape from circular cross-sectional shape.

13. Radiant heater according to claim 1, wherein the insulator is press-shaped.

14. Radiant heater according to claim 13, wherein the insulator is a hardened insulator.

15. Radiant heater according to claim 1, in which a a side of the heater coil of minor curvature provides lateral guiding means for insertion of the coils into the insulator.

* * * * *

UNITED STATES PATENT AND TRADEMARK OFFICE

CERTIFICATE OF CORRECTION

PATENT NO. : 4,789,773

DATED : December 6, 1988

INVENTOR(S) : Bernhard Mikschl

It is certified that error appears in the above-identified patent and that said Letters Patent is hereby corrected as shown below:

Column 3, line 55 before "still" insert --is--.

Signed and Sealed this

Seventh Day of November, 1989

*Attest:*

JEFFREY M. SAMUELS

*Attesting Officer*

*Acting Commissioner of Patents and Trademarks*